US007322406B2

(12) United States Patent
Wiggins et al.

(10) Patent No.: US 7,322,406 B2
(45) Date of Patent: Jan. 29, 2008

(54) ELEVATION SENSOR FOR A SERVICE HOSE AND AN APPARATUS FOR POSITIONING AND STABBING WELL TUBULARS

(75) Inventors: Richard J. Wiggins, Lafayette, LA (US); Brian D. Begnaud, Youngsville, LA (US); Jebb L. Huval, Lafayette, LA (US); Stefan Schmidt, Rayne, LA (US); Charles Michael Webre, Lafayette, LA (US)

(73) Assignee: Frank's Casing Crew & Rental Tools, Inc., Lafayette, LA (US)

( * ) Notice: Subject to any disclaimer, the term of this patent is extended or adjusted under 35 U.S.C. 154(b) by 320 days.

(21) Appl. No.: 10/893,160

(22) Filed: Jul. 16, 2004

(65) Prior Publication Data

US 2006/0011350 A1 Jan. 19, 2006

(51) Int. Cl.
*E21B 19/02* (2006.01)

(52) U.S. Cl. ..... 166/66; 166/77.51; 166/77.53; 166/85.1; 166/85.5; 175/40; 175/85; 175/113; 175/162; 414/22.65; 414/22.68; 414/22.71

(58) Field of Classification Search ..... 166/380, 166/77.51–77.53, 85.1, 85.5; 175/113, 162, 175/40, 85; 414/22.55–22.61, 22.65–22.71; 254/269; 294/88, 106
See application file for complete search history.

(56) References Cited

U.S. PATENT DOCUMENTS

| | | | | |
|---|---|---|---|---|
| 3,828,943 | A * | 8/1974 | Simon | 414/22.71 |
| 3,883,009 | A * | 5/1975 | Swoboda et al. | 414/22.65 |
| 4,440,220 | A * | 4/1984 | McArthur | 166/85.5 |
| 4,524,952 | A * | 6/1985 | Rome et al. | 254/269 |
| 4,921,386 | A * | 5/1990 | McArthur | 414/22.51 |
| 5,049,020 | A | 9/1991 | McArthur | |
| 5,762,150 | A * | 6/1998 | Cheng et al. | 414/22.66 |
| 6,220,807 | B1 * | 4/2001 | Sorokan | 414/22.62 |
| 7,178,612 | B2 * | 2/2007 | Belik | 175/162 |

* cited by examiner

*Primary Examiner*—Richard Chilcot
*Assistant Examiner*—Matthew J. Smith
(74) *Attorney, Agent, or Firm*—Fellers, Snider, Blankenship, Bailey & Tippens, P.C.; Dennis D. Brown

(57) ABSTRACT

An operational system and method and improved apparatus for positioning and stabbing well tubulars wherein: the grasping members of the apparatus can be folded and unfolded; the boom assembly can be pivoted to a downward clearance position; a plurality of stabbing apparatuses can be placed and used in a stacked position in the derrick; the grasping members can opened at an angle with respect the boom; the grasping members can be mounted on either lateral side of the boom; a sensor monitors the relative position of the rig top drive with respect to the stabbing apparatus; the grasping members and/or the boom will automatically pivot to a breakaway position if impacted; and/or the system is programmed and configured to prevent the accidental performance of critical operations out of sequence.

26 Claims, 12 Drawing Sheets

ELEVATION SENSOR FOR A SERVICE HOSE AND AN APPARATUS FOR POSITIONING AND STABBING WELL TUBULARS

FIELD OF THE INVENTION

The present invention relates to apparatuses, systems, and methods for connecting well tubulars together to be run down hole. More particularly, but not way of limitation, the present invention relates to apparatuses, systems, and methods for stabbing suspended well tubulars.

BACKGROUND OF THE INVENTION

In connecting together a series of individual casing segments or other tubulars and running the assembled string down a well, each tubular is typically first lifted up into the well derrick structure. The lower end of each suspended tubular is then added to the tubular string by threadedly connecting the lower end of the suspended tubular to the upper end of the string at a point of connection near the rig floor. During the connecting operation, the upper end of the assembled string is typically held by a rotary table, spider or other gripping device located on the rig floor such that the remainder of the string is suspended in the well. When the connection is completed, the gripping device at the rig floor is released in order to allow the newly attached section to be lowered into the well. Once lowered, the upper end of the added section is then gripped at the rig floor by the rotary gripping device so that the next tubular section can then be lifted into the derrick and threadedly connected to the assembled string.

A prior art derrick system for assembling a string of casing segments or other tubulars and running the assembled tubular string down a well is described in U.S. Pat. No. 4,921,386. The entire disclosure of U.S. Pat. No. 4,921,386 (hereinafter referred to as the '386 patent) is incorporated herein by reference. The prior art derrick system 2 described in the '386 patent is schematically illustrated in FIG. 1. The prior art system 2 comprises: a rig floor or drilling platform 4; a rotary table system or other gripping device 6 which holds the upper end 8 of the assembled string; a derrick structure 10; a suspended traveling block and swivel assembly 12 which can be operated for lifting, suspending, and lowering additional tubular segments 14 within derrick 10; and a stabbing apparatus 20 positioned within derrick 10 for stabbing the suspended tubular section 14. As used herein, the term "stabbing" refers to the operation of stabilizing, positioning, aligning, and/or otherwise directing the lower end of the suspended tubular segment 14 into engagement with the upper end of the tubular string 8 for connecting the lower end of the tubular segment 14 to the upper end of the tubular string 8.

The prior art stabbing apparatus 20 described in the '386 patent is depicted in FIGS. 2 through 5. The prior art stabbing apparatus 20 includes: a bracket and base assembly 22 which can be removably secured to or on a derrick cross-member or other structure within derrick 10; a boom assembly 24 which is pivotably secured to the bracket and base assembly 22 for up and down movement; and a remote control system 26 which is used for operating the stabbing apparatus 20. It has also been known heretofore that a single stabbing apparatus of this type can be mounted on a track for vertical movement within the derrick.

The boom assembly 24 of prior art stabbing apparatus 20 comprises: a telescoping boom 28 which can be extended and retracted; a pair of grasping members 30 carried on the distal end of boom 28; an internal piston and cylinder assembly 32 for extending and retracting the boom 28; a lifting piston and cylinder assembly 34 connected between the boom assembly 24 and the bracket and base assembly 22 for pivoting the boom assembly 24 up and down; a limit switch assembly 35 which will detect that the boom assembly 24 has reached a desired horizontal position and will then prevent the boom assembly from pivoting further downward; a yawing piston and cylinder assembly 36 for pivoting the boom 28 from side-to-side; and a boom housing structure 38 which holds the boom 28 and the yawing piston and cylinder assembly 36 in a manner effective for enabling the yawing piston and cylinder assembly 36 to be operated without interfering with the lifting piston and cylinder assembly 34.

The boom housing structure 38 includes a box structure 40 in which the base of the boom 28 and the base of yawing piston and cylinder assembly 36 are each pivotably retained for side-to-side movement. The boom housing structure 40 also includes a bottom plate structure 42 which extends forwardly from the bottom of the box 40. The distal end of the lifting piston and cylinder assembly 34 is attached to the plate structure 42 for lifting both the boom 28 and the boom housing structure 38.

The lifting piston and cylinder assembly 34 of the prior art stabbing apparatus 20 is operable for pivoting the boom assembly 24 between a substantially horizontal operating position, as illustrated in FIG. 1, and a substantially vertical clearance position. As used herein, "substantially horizontal" refers to a position which is within +/−5° of true horizontal.

The grasping members 30 of the prior art stabbing apparatus 20 are a pair of jaw structures which are retained on the distal end of boom 28 by a jaw bracket 44. The proximal ends of the jaws 30 are pivotably retained in the jaw bracket 44 by pivot pins 46. A lateral piston and cylinder assembly 48 is connected between the proximal ends of jaws 30 for pivoting the jaws 30 between an open position for receiving and releasing the suspended tubular segment 14 and a closed position (shown in FIG. 2) for grasping the suspended tubular 14. Radially adjustable rollers 50 are provided in the jaws 30 for contacting and holding the suspended tubular 14 while also allowing the tubular 14 to be rotated within the jaws 30 for threadedly connecting the tubular 14 to the upper end of the tubular string 8.

The remote control system 26 of the prior art stabbing apparatus 20 includes a bank assembly 52 of valves. The valve bank 52 is removably secured above the boom housing box 40. The valves are electrically operated solenoid-type valves, each of which is used to control hydraulic fluid flow to a separate one of the piston and cylinder assemblies 32, 34, 36, and 48 used for extending the boom 28, pivoting the boom 28 from side-to-side, pivoting the boom assembly 24 up and down, and opening and closing the grasping members 30.

The remote control assembly 26 also includes: a hand-held remote 54; a bundle of electrical leads 56 extending from the hand-held remote 54 to the valve bank 52 for operating and controlling the various solenoid valves; four switches 56-62 provided on the hand-held remote 54 for separately operating the extending, lifting, yawing, and grasping piston and cylinder assemblies 32, 34, 36, and 48; and a guard 64 provided on the hand-held remote over the toggle switches 56-62 for protecting the toggle switches from damage and for preventing the switches from being inadvertently actuated in the event that the hand-held remote is dropped.

SUMMARY OF THE INVENTION

The present invention provides improved apparatuses, systems, procedures, and methods for stabbing tubulars, assembling tubular strings, and operating stabbing devices. These inventive improvements can be used on their own or in conjunction with generally any rig or stabbing apparatus, system, procedure, or method employed heretofore, including but not limited to the prior art derrick system 2 and the prior art stabbing apparatus 20 described in the '386 patent. The inventive apparatuses, systems, procedures, and methods provide substantial improvements in operational utility, effectiveness, and flexibility and have significantly enhanced adaptability for use in different rig structures and arrangements.

In one aspect, there is provided an improvement to an apparatus for stabbing a suspended tubular wherein the apparatus includes a boom which is pivotable up and down and at least one grasping member carried by the boom, the grasping member being movable relative to the boom in a grasping and releasing movement for receiving, grasping, and releasing the tubular. The improvement comprises the grasping member also being movable relative to the boom in a folding and unfolding movement, different from the grasping and releasing movement, for folding and unfolding the grasping member with respect to the boom.

In another aspect, there is provided an improvement to an apparatus for stabbing a suspended tubular, wherein the apparatus includes a boom assembly and a base which retains the boom assembly for pivoting movement of the boom assembly with respect to the base and the boom assembly comprises a boom and at least one grasping member carried by the boom for releasably grasping the tubular. The improvement comprises the boom assembly being downwardly pivotable, with respect to the base, from a substantially horizontal position. The boom assembly is preferably pivotable at least 60° downward from the substantially horizontal position and is most preferably pivotable about 90° downward from the substantially horizontal position.

In another aspect, there is provided an apparatus for grasping and positioning a tubular suspended in a derrick wherein the apparatus comprises a first stabbing assembly positioned in the derrick and a second stabbing assembly positioned in the derrick above the first stabbing assembly. The first stabbing assembly and the second stabbing assembly each comprise a boom which is either pivotable up and down, pivotable from side-to-side, or both pivotable up and down and pivotable from side-to-side and at least one grasping member carried by the boom for releasably grasping the tubular.

In another aspect, there is provided an apparatus for grasping and positioning a suspended tubular comprising: a vertical track; a first stabbing assembly; and a second stabbing assembly. The first stabbing assembly includes a first stabbing assembly boom which is either pivotable up and down, pivotable from side-to-side, or both pivotable up and down and pivotable from side-to-side and at least one first stabbing assembly grasping member carried by the first stabbing assembly boom for releasably grasping the tubular. The second stabbing assembly includes a second stabling assembly boom which is either pivotable up and down, pivotable from side-to-side, or both pivotable up and down and pivotable from side-to-side and at least one second stabbing assembly grasping member carried by the second stabbing assembly boom for releasably grasping the tubular. The first stabbing assembly is movably mounted on the vertical track and the second stabbing assembly is movably mounted on the vertical track above the first stabbing assembly.

In another aspect, there is provided an improved apparatus for stabbing a suspended tubular wherein the apparatus includes a boom, a first grasping member, and a second grasping member, the boom having a longitudinal axis, the boom being either pivotable up and down, pivotable from side-to-side, or both pivotable up and down and pivotable from side-to-side, the first and second grasping members being carried by the boom, and the first and second grasping members being openable and closable for receiving, grasping, and releasing the tubular. When the first and the second grasping members are opened, a gap for receiving or releasing the tubular is formed between the first and second grasping members. The improvement comprises the centerpoint of the gap being located at an angle from the longitudinal axis of the boom. The angle is preferably at least 45° from the longitudinal axis.

In another aspect, there is provided an improved apparatus for performing well operations including a derrick and a top drive and/or a traveling block provided in the derrick for vertical movement. The improvement comprises a sensor positioned in a manner effective for sensing an elevation of the top drive, or traveling block.

In another aspect, there is provided an improved apparatus for stabbing a suspended tubular, the apparatus including a boom and a pair of grasping members, the boom being either pivotable up and down, pivotable from side-to-side, or both pivotable up and down and from side-to-side, and the pair of grasping members being openable and closable for receiving, grasping, and releasing the tubular. The improvement comprises the grasping members being mounted on a lateral side of the boom.

In another aspect, there is a provided an improved apparatus for stabbing a suspended tubular wherein the apparatus includes a boom assembly comprising a boom which carries at least one grasping member for grasping the tubular. The improvement comprises a first portion of the boom assembly being connected to a second portion of the boom assembly in a manner such that, in the event that the first portion of the boom assembly is struck by an object traveling downward, the first portion of the boom assembly will remain attached to the second portion of the boom assembly but the first portion of the boom assembly will automatically pivot downwardly with respect to the second portion of the boom assembly.

In another aspect, there is provided an improved apparatus for stabbing a suspended tubular wherein the apparatus includes a base and a boom assembly pivotably connected to the base, the boom assembly comprising a boom and at least one grasping member carried by the boom for grasping the tubular. The improvement comprises the boom assembly being connected to the base in a manner such that, in the event that the boom assembly is struck by an object traveling downwardly, the boom assembly will remain attached to the base but will automatically pivot downward with respect to the base.

In another aspect, there is provided a method of operating a stabbing apparatus for stabbing a tubular. The apparatus includes a boom which carries at least one grasping member, the boom being extendable and retractable, the boom being pivotable between a substantially horizontal position and a clearance position, and the grasping member being moveable between a closed position for grasping the tubular and an open position for receiving and releasing the tubular. The method comprises the steps of: (a) automatically determining whether a condition exists, the condition being that the boom is in an extended position, the grasping member is in the closed position, or a combination thereof, and automatically preventing the boom from being pivoted from the clearance position to the substantially horizontal position when the condition exists, and (b) pivoting the boom from the clearance position to the substantially horizontal position including, when the condition is determined to exist in step (a), retracting the boom, opening the grasping member, or a combination thereof as needed prior to pivoting the boom from the clearance position to the substantially horizontal position such that the condition does not exist and the boom is not prevented from being pivoted to the substantially horizontal position.

In another aspect, there is provided a method of operating a stabbing apparatus for stabbing a suspended tubular wherein the apparatus includes a boom which carries at least one grasping member, the boom is extendable and retractable, the grasping member is movable between a closed position for grasping the tubular and an open position for releasing the tubular, and the grasping member is also pivotable with respect to the boom between a folded position and an unfolded position. The method comprises the steps of: (a) automatically determining whether a condition exists, the condition being that the boom is in an extended position, the grasping member is in the closed position, or a combination thereof, and automatically preventing the grasping member from being pivoted from the folded position to the unfolded position when the condition exists, and (b) pivoting the grasping member from the folded position to the unfolded position including, when the condition is determined to exist in step (a), retracting the boom, opening the grasping member, or a combination thereof as needed prior to pivoting the grasping member from the folded position to the unfolded position such that the condition does not exist and the grasping member is not prevented from being pivoted to the unfolded position.

In yet another aspect, there is provided a method of operating a stabbing apparatus for stabbing a suspended tubular, wherein the apparatus includes a boom which carries at least one grasping member, the boom is extendable and retractable, the boom is also pivotable between a substantially horizontal position and a clearance position, the grasping member is movable between a closed position for grasping the tubular and an open position for receiving and releasing the tubular, and the grasping member is also pivotable with respect to the boom between a folded position and an unfolded position. The method comprises the steps of: (a) automatically determining whether a condition exists, the condition being that the boom is in an extended position, the grasping member is in the closed position, the grasping member is in the unfolded position, or a combination thereof, and automatically preventing the boom from being pivoted from the clearance position to the substantially horizontal position when the condition exists, and (b) pivoting the boom from the clearance position to the substantially horizontal position including, when the condition is determined to exist in step (a), retracting the boom, opening the grasping member, pivoting the grasping member to the folded position, or a combination thereof as needed prior to pivoting the boom from the clearance position to the substantially horizontal position such that the condition does not exist and the boom is not prevented from being pivoted to the substantially horizontal position.

Further objects, features and advantages of the present invention will be apparent to those in the art upon examining the accompanying drawings and upon reading the following detailed description of the preferred embodiments.

DETAILED DESCRIPTION OF THE PREFERRED EMBODIMENTS

Figure 1:
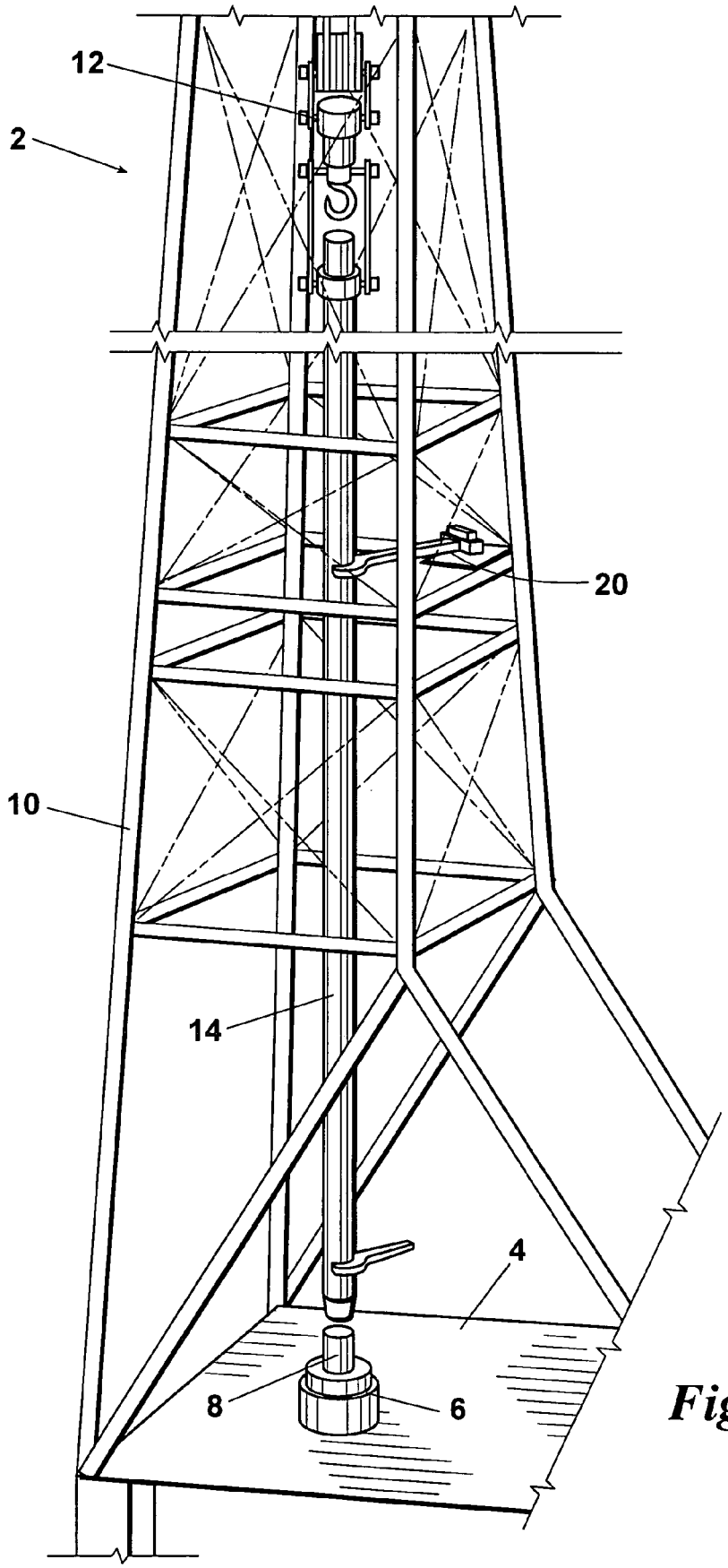
FIG. 1 schematically illustrates a prior art derrick system 2 of a type described in U.S. Pat. No. 4,921,386.
Figure 2:
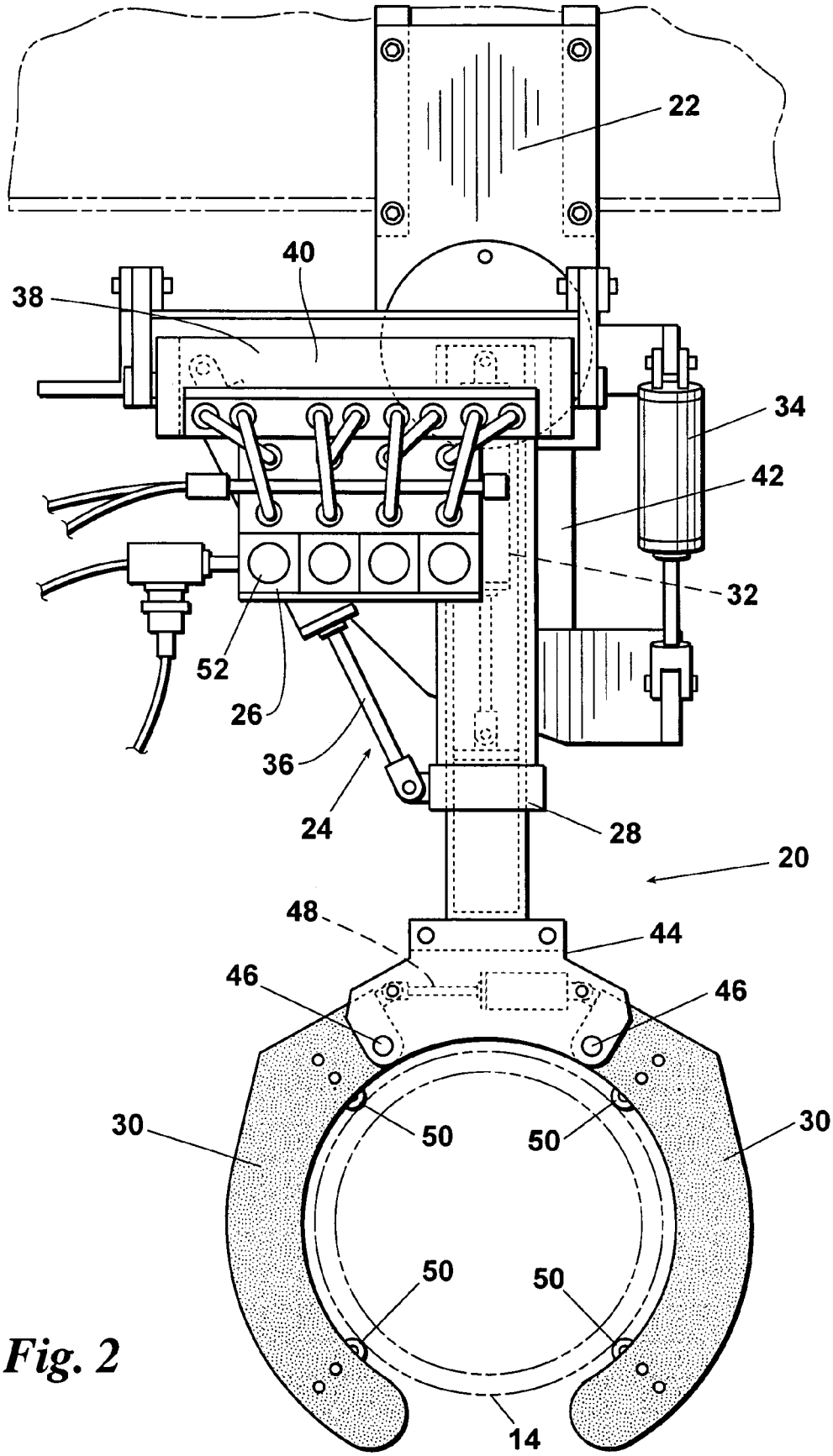
FIG. 2 is a plan view of a prior art stabbing apparatus 20 employed in system 2.
Figure 3:
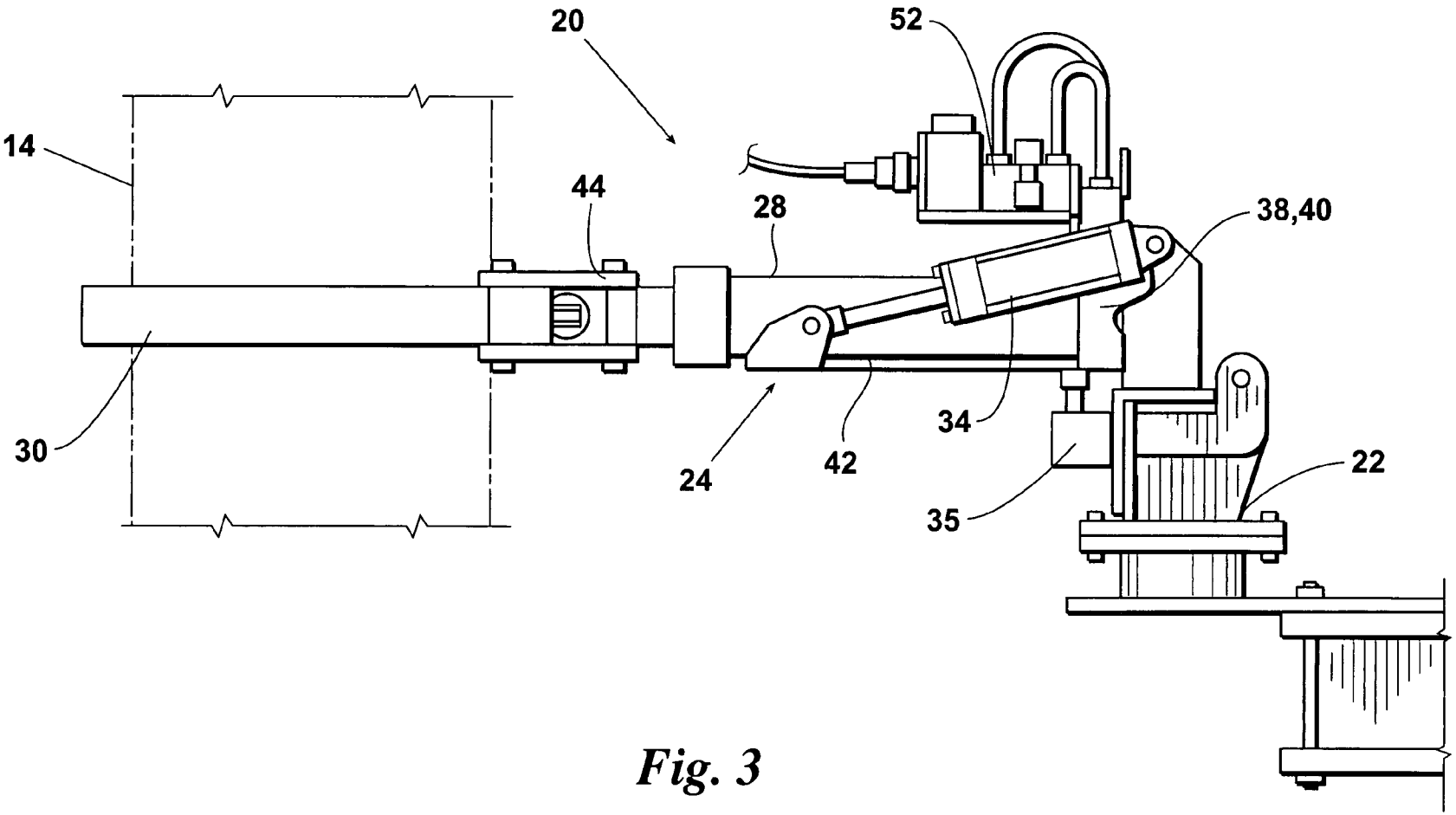
FIG. 3 is an elevational side view of the prior art stabbing apparatus 20.
Figure 4:
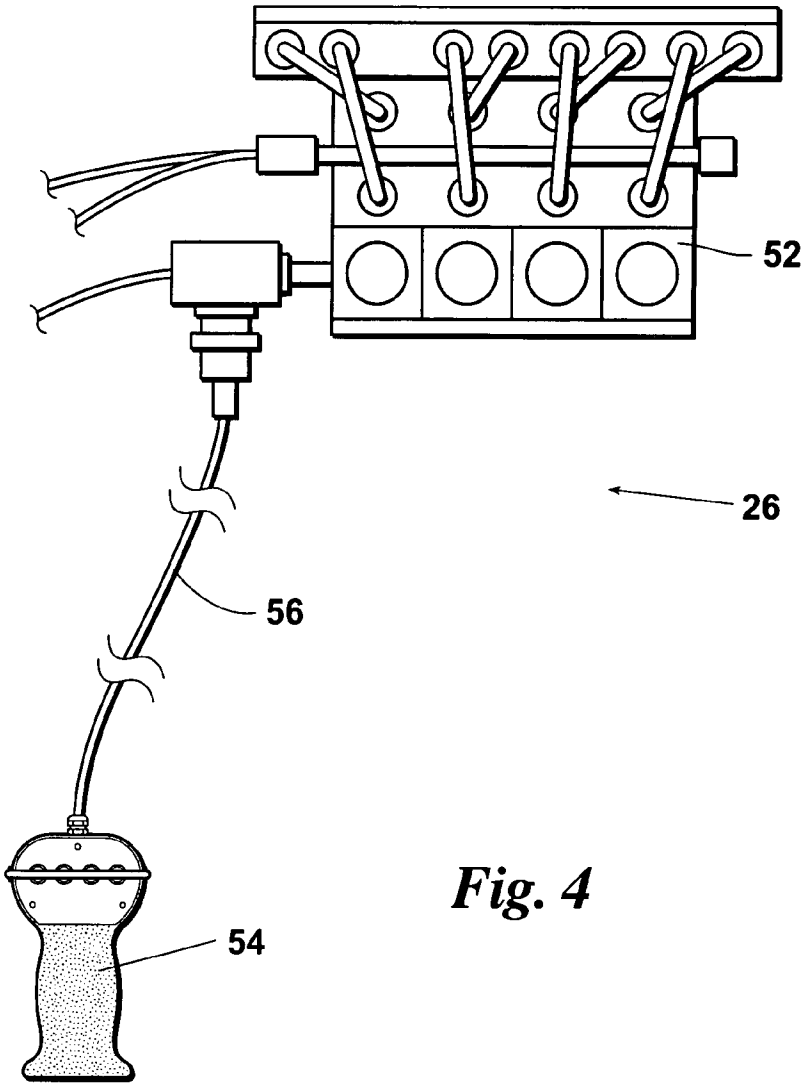
FIG. 4 illustrates a prior art remote control system 26 used for operating the prior art stabbing apparatus 20.
Figure 5:
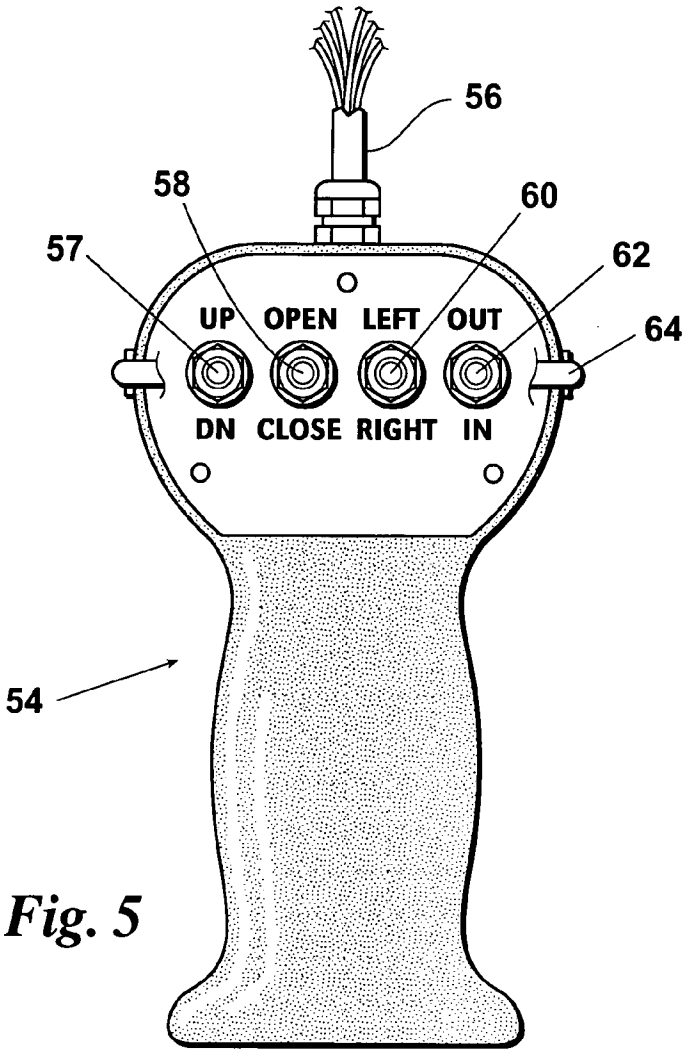
FIG. 5 depicts a hand-held remote 54 used in the prior art remote control system 26.
Figure 6:
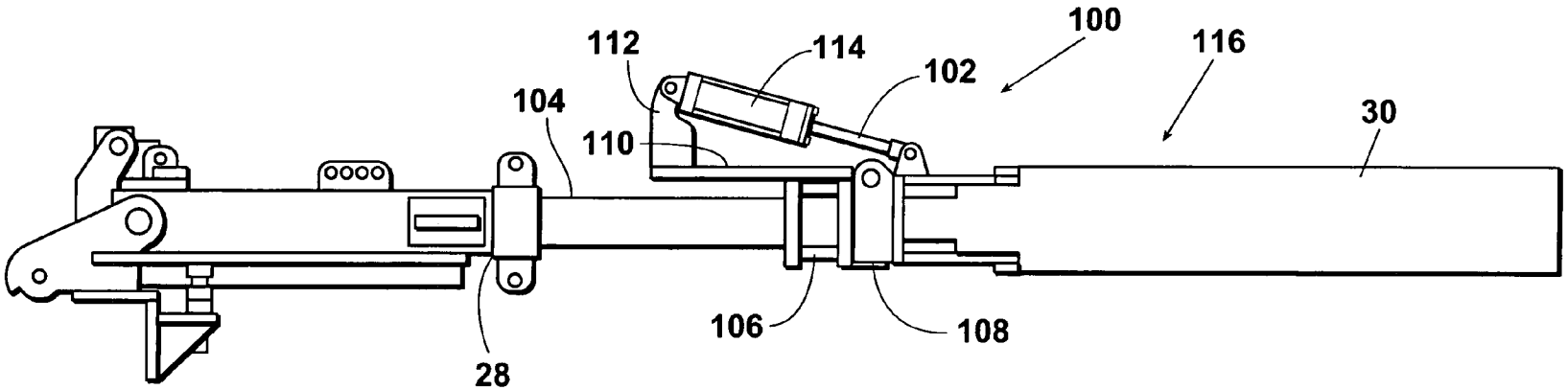
FIG. 6 is an elevational side view of an embodiment 100 of the stabbing apparatus provided by the present invention in an unfolded position.
Figure 7:
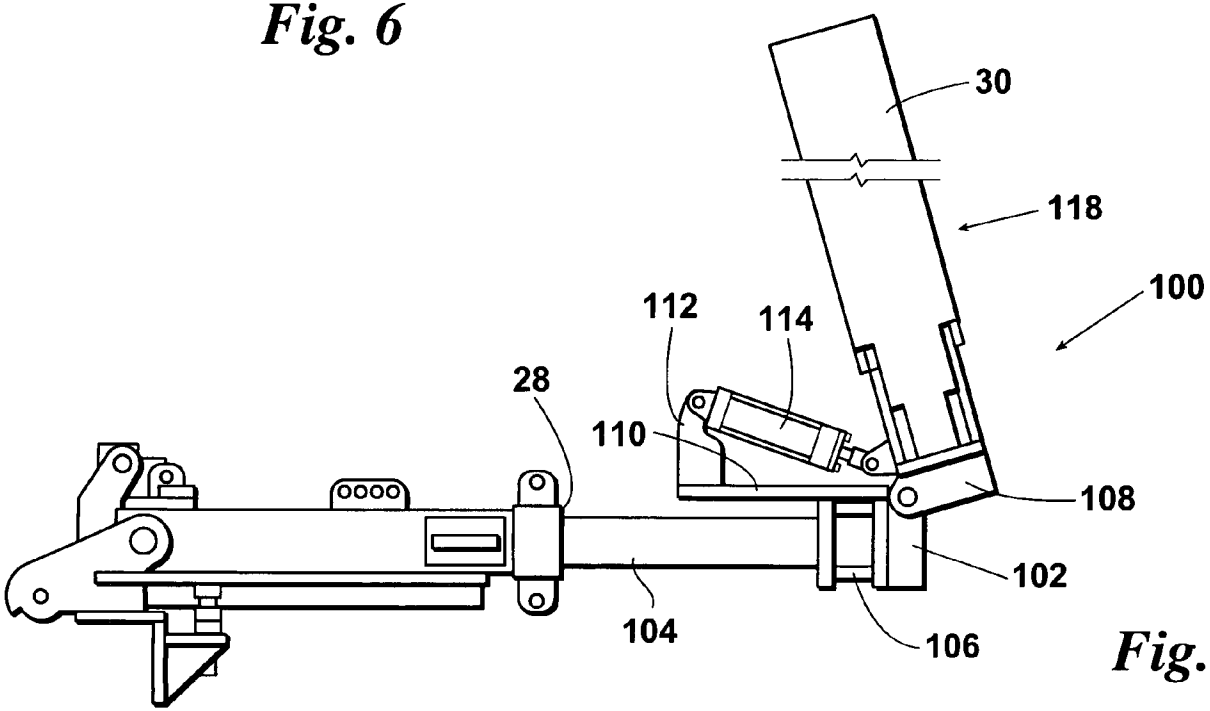
FIG. 7 is an elevational side view of the inventive stabbing apparatus 100 in a folded position.

A first embodiment 100 of the inventive improved stabbing apparatus is illustrated in FIGS. 6-10. The improved apparatus 100 can, for example, be essentially identical to the prior art stabbing apparatus 20 described above except that the jaw bracket 44 of the prior art stabbing apparatus 20 has been replaced with an inventive wrist bracket assembly 102. As shown in FIGS. 6 and 7, the inventive wrist bracket assembly 102 is mounted on the distal end of the telescoping segment 104 of boom 28. However, as discussed hereinbelow, the inventive wrist bracket assembly 102 could alternatively be mounted on either lateral side of the telescoping boom segment 104.

The inventive wrist bracket assembly 102 preferably comprises: a boom bracket 106 which is removably secured on the telescoping boom segment 104; a grasping member bracket 108 which is pivotably secured to the boom bracket 106; a boom bracket plate 110 which extends rearwardly from the top of boom bracket 106; an attachment ear 112 which extends upwardly from the rearward portion of boom bracket plate 110; and a piston and cylinder assembly 114 which is connected between the attachment ear 112 and the grasping member bracket 108 for pivoting the grasping member bracket 108 up and down with respect to the boom bracket 106.

One or more (preferably two) jaw(s) 30 of the type described above or other grasping member(s) is/are pivotably retained in the grasping member bracket 108 of the inventive wrist assembly 102 for grasping and releasing a suspended tubular. The inventive wrist bracket assembly 102 is operable for pivoting the grasping member(s) 30 between an unfolded operating position 116 as illustrated in FIG. 6 and a folded (clearance) position 118 as illustrated in FIG. 7. The folded (clearance) position 118 of the grasping member(s) 30 will preferably be at least 60° from the unfolded position 118 and will most preferably be at least 90° from the unfolded position 116.

Figure 8:
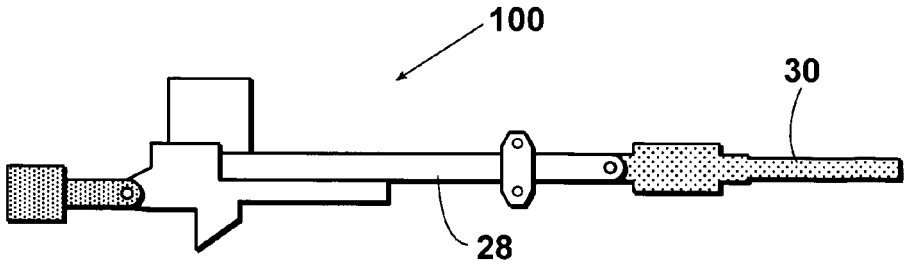
FIG. 8 schematically illustrates an elevational side view of inventive stabbing apparatus 100 in a substantially horizontal operating position.
Figure 9:
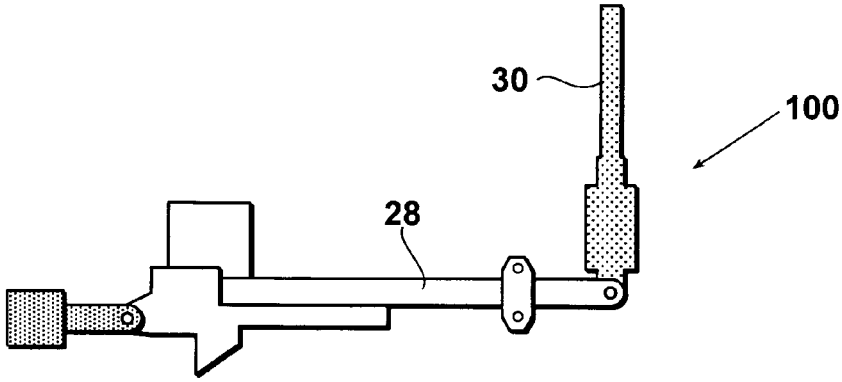
FIG. 9 schematically illustrates an elevational side view of inventive stabbing apparatus 100 in a partially folded position.
Figure 10:
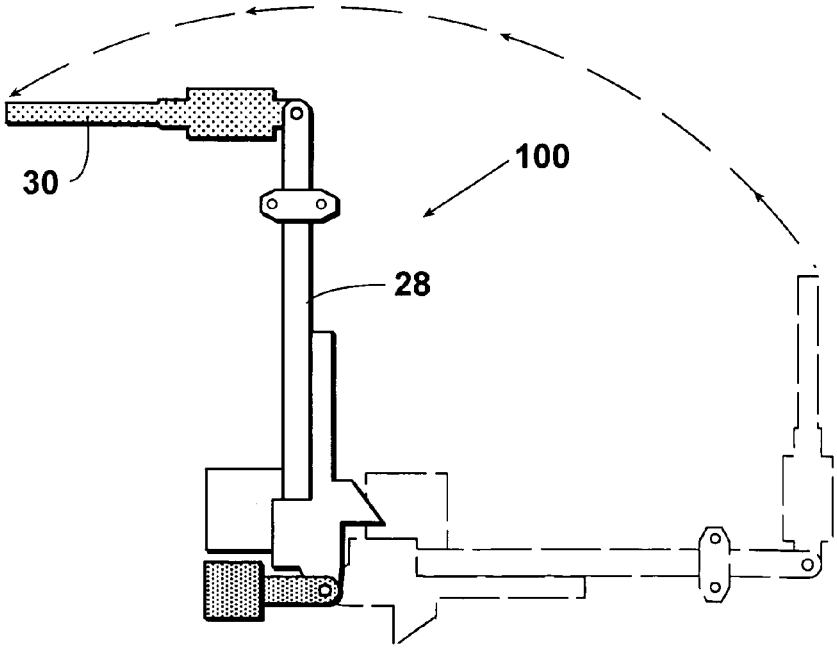
FIG. 10 schematically illustrates an elevational side view of inventive stabbing apparatus 100 in a fully folded clearance position.

Because the inventive stabbing apparatus 100 is preferably essentially identical in all other respects to the prior art apparatus 20, the boom 28 of inventive apparatus 100 can also be extended and retracted, pivoted up and down, and pivoted from side-to-side. In FIG. 8, the boom 28 and the grasping member(s) 30 of improved apparatus 100 have been lowered to place the apparatus 100 in a substantially horizontal operating position. In FIG. 9, the boom 28 of improved apparatus 100 is still in its substantially horizontal position but the grasping member(s) 30 have been rotated (folded) upward to a substantially vertical clearance position. FIG. 10 illustrates a fully folded position of the improved apparatus 100 wherein the grasping member(s) 30 is/are in a folded position with respect to the boom 28 and the boom 28 has also been pivoted upward to a substantially vertical clearance position.

Figure 11:
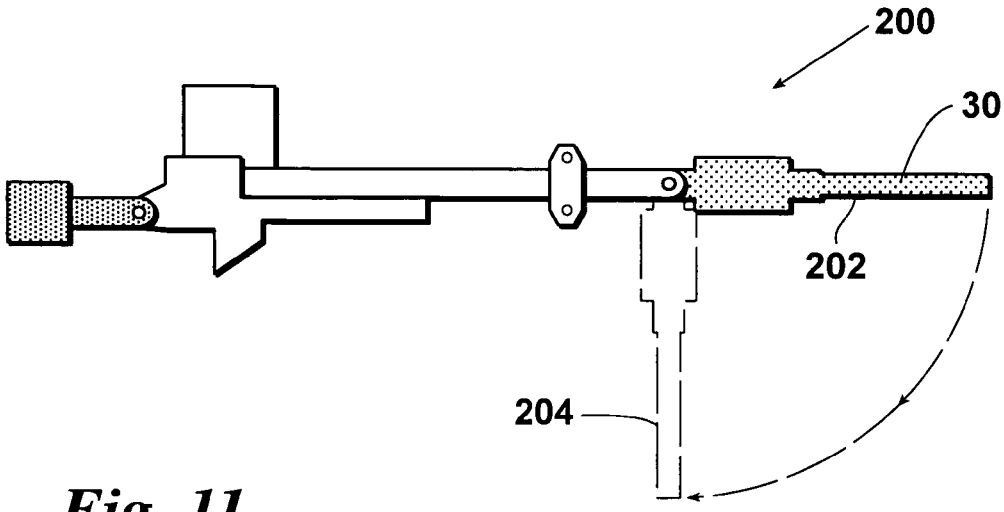
FIG. 11 schematically illustrates an elevational side view of an embodiment 200 of the inventive stabbing apparatus in both a substantially horizontal operating position and a partially folded position.

A second embodiment 200 of the inventive improved stabbing apparatus is illustrated in FIG. 11. The grasping member(s) 30 of inventive apparatus 200 is/are downwardly pivotable with respect to the boom from an unfolded position 202 to a folded (clearance) position 204. The folded position 204 is preferably at least 60° from the unfolded position 202 and is most preferably at least 90° from the unfolded position 202.

The downward folding action of the grasping member(s) 30 of apparatus 200 can be accomplished, for example, using a wrist bracket assembly, similar to wrist bracket assembly 102, wherein (a) the boom bracket plate and the pivoting piston and cylinder assembly are moved to the bottom of the bracket assembly and (b) the pivot point between the boom bracket and the grasping member bracket is moved to the bottom of the wrist joint to allow downward rotation. In other words, the wrist bracket assembly used for folding the grasping member(s) 30 of inventive apparatus 300 downward can simply be an inverted version of the inventive wrist bracket assembly 102.

An additional advantage of the improved apparatus 200 is that the downward folding action of the grasping member(s) 30 facilitates the incorporation of an inventive safety breakaway feature. The inventive breakaway feature operates such that, in the event that the outer portion of stabbing apparatus 200 is struck by equipment or objects moving downward within the derrick, the grasping member(s) 30 will remain attached to boom 28 but the impact will cause the grasping member(s) 30 to automatically pivot downward to folded position 204. This breakaway action will prevent the apparatus 200, or any portion thereof, from being knocked to the rig floor.

The desired breakaway action can be provided, for example, by using a shear pin connection, or other attachment designed to break away under a set impact load, for connecting at least one end of the wrist bracket piston and cylinder to the wrist bracket assembly. It is preferred, however, that the breakaway action be provided by using a wrist bracket pivoting piston and cylinder assembly which incorporates a rupture disk or other known pressure relief device which will automatically relieve the pressure within the piston and cylinder assembly on impact to thereby allow the piston to freely retract into the cylinder and thus permit the grasping member(s) 30 to automatically pivot downward.

Figure 12:
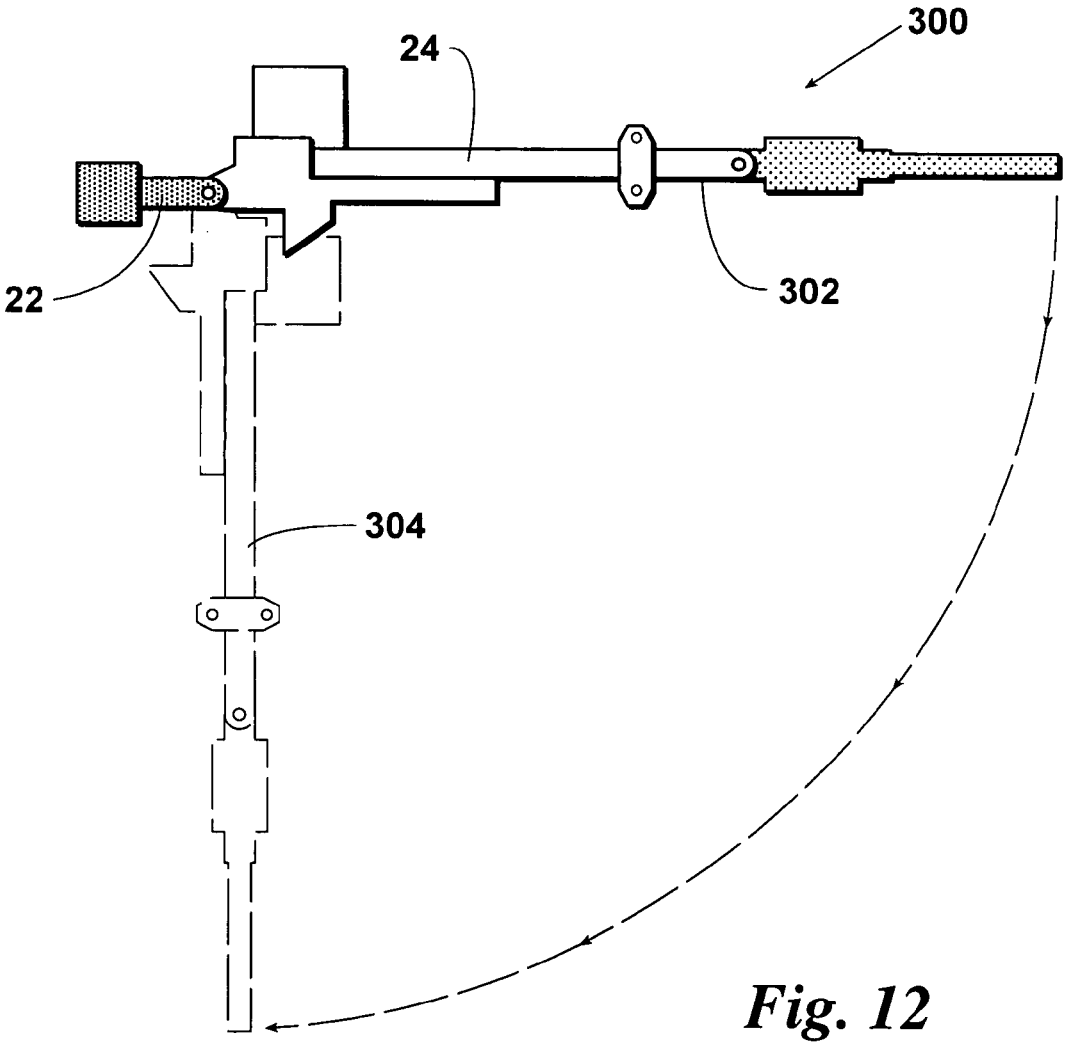
FIG. 12 schematically illustrates an elevational side view of an embodiment 300 of the inventive stabbing apparatus in a substantially horizontal operating position and in a downwardly pivoted clearance position.

A third embodiment 300 of the inventive improved stabbing apparatus is schematically illustrated in FIG. 12. Apparatus 300 is a downwardly pivotable apparatus wherein the entire boom assembly 24 can be pivoted relative to the base 22 between a substantially horizontal position 302 and a downward clearance position 304. The downward clearance position 304 is preferably at least 60° from the substantially horizontal position 302 and is most preferably about 90° from the substantially horizontal position 302. A downward pivoting motion of this type can be provided, for example, by (a) moving the pivot point between the base 22 and the boom assembly 24 of the prior art stabbing apparatus 20 outward to accommodate the downward pivoting motion and (b) relocating the lifting piston and cylinder assembly 34 of the apparatus 20 from the top of the apparatus to the bottom of the apparatus. In this arrangement, the lifting piston and cylinder assembly will be extended to push the boom 28 and boom housing and plate structure 38 upward to the substantially horizontal position 302 and will be retracted when pivoting the boom assembly 24 downward to its clearance position 304.

The inventive apparatus 300 will also readily accommodate an inventive safety breakaway feature wherein, if struck by equipment or objects traveling downward in the derrick, the entire boom assembly 24 will remain attached to the base structure 22 but will automatically pivot downwardly to its clearance position 304. Similar to inventive apparatus 200, the breakaway action of inventive apparatus 300 will preferably be provided, for example, by using a boom lifting piston and cylinder assembly which incorporates a rupture disk or other known pressure relief device which will automatically relieve the pressure within the piston and cylinder assembly on impact so as to allow the piston to freely retract into the cylinder.

Figure 13:
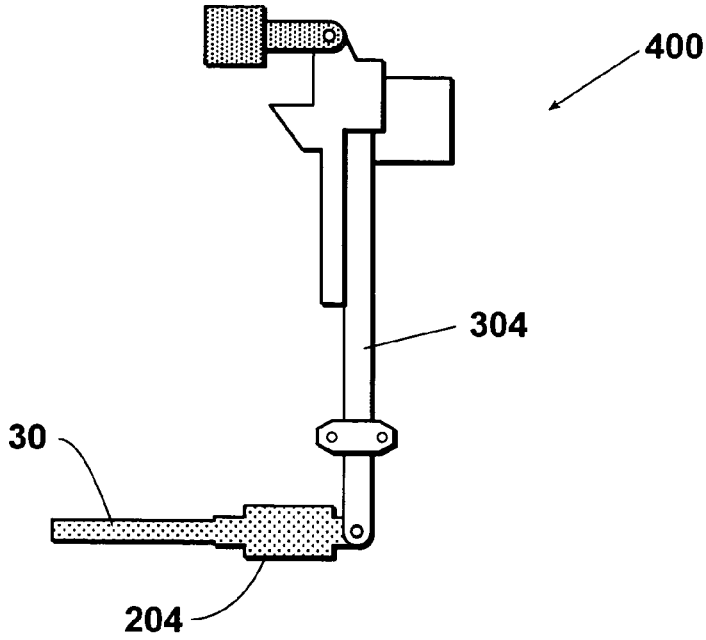
FIG. 13 schematically illustrates an elevational side view of an embodiment 400 of the inventive stabbing apparatus in a fully downwardly folded clearance position.

A fourth embodiment 400 of the inventive improved stabbing apparatus is schematically illustrated in FIG. 13. Apparatus 400 incorporates the inventive features of both inventive apparatus 200 and inventive apparatus 300. As shown in FIG. 13, the grasping member(s) 30 of inventive apparatus 400 can be pivoted downwardly with respect to the boom 28 to a folded position 204. In addition, the entire boom assembly 24 of apparatus 400 can be pivoted downwardly to a downward clearance position 304.

Figure 16:
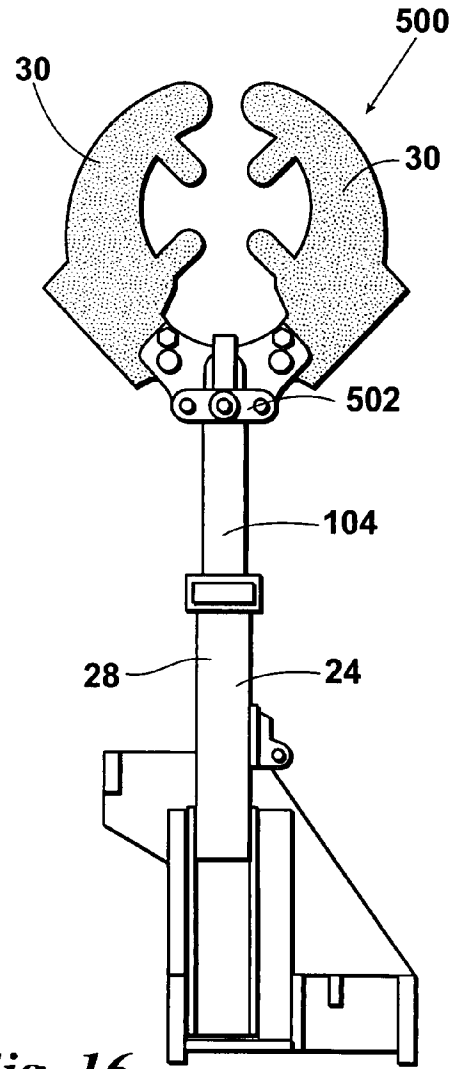
FIG. 16 is a plan view of inventive stabbing apparatus 500 wherein the grasping members thereof are removably mounted on the distal end of the boom.
Figure 15:
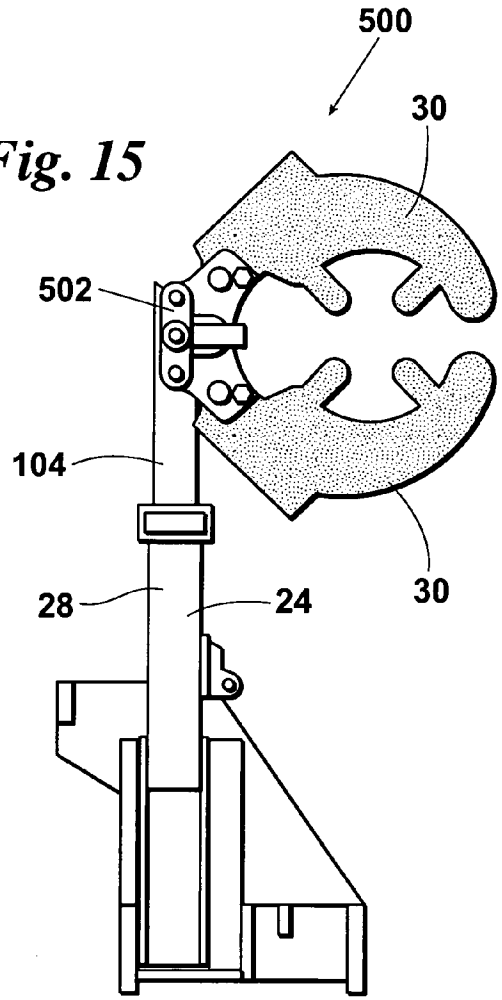
FIG. 15 is a plan view of inventive stabbing apparatus 500 wherein the grasping members are removably mounted on the right lateral side of the boom.
Figure 14:
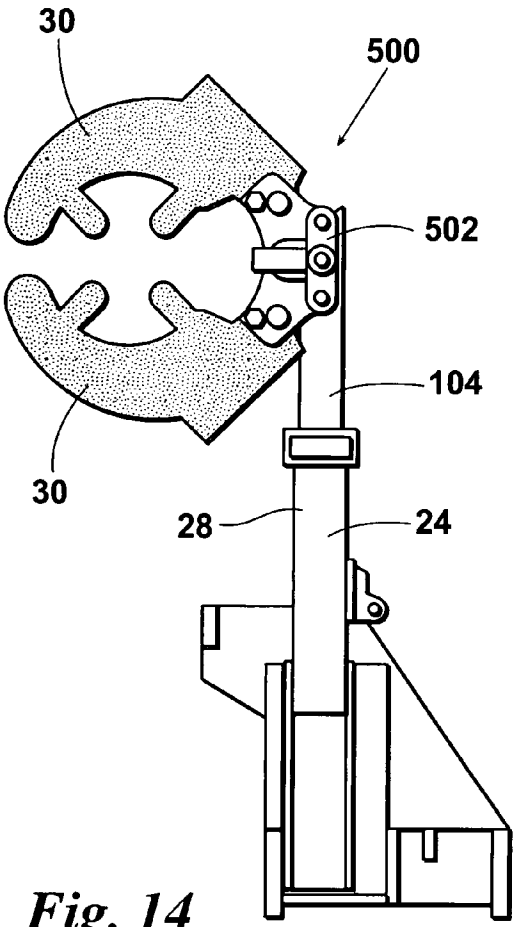
FIG. 14 is a plan view of an embodiment 500 of the inventive stabbing apparatus wherein the grasping members thereof are removably mounted on the left lateral side of the boom.

A fifth embodiment 500 of the inventive improved stabbing apparatus is illustrated in FIGS. 14-16. Improved apparatus 500 includes an inventive removable jaw bracket assembly 502 which can be selectively attached to the telescoping segment 104 of boom 28 such that the grasping member(s) 30 can be mounted on the lateral left side of boom 28 as illustrated in FIG. 14, or on the lateral right side of boom 28 as illustrated in FIG. 15, or on the distal end of boom 28 as illustrated in FIG. 16.

Alternatively, rather than using a repositionable jaw bracket 502, the grasping member(s) 30 of the improved apparatus 500 can be permanently mounted on either the left lateral side or the right lateral side of the boom 28. In addition, regardless of whether the grasping member(s) 30 is/are permanently mounted on one side of the boom or can be moved from on one side to the other, it will be understood that the jaw bracket 502 employed in apparatus 500 can be a wrist-type bracket assembly of the type discussed above which will allow the grasping member(s) 30 of apparatus 500 to be pivoted with respect to boom 28 between an unfolded position and a folded (clearance) position. The folded clearance position can be either an upwardly pivoted position or a downwardly pivoted position. Further, the inventive apparatus 500 can include any or all of the other features of the prior art stabbing apparatus 20 and/or the various inventive apparatuses discussed above such that the boom assembly 24 of inventive apparatus 500 can be pivoted between a substantially horizontal position and a clearance position (i.e., either an upward or a downward clearance position) and can be selectively extended and retracted and pivoted from side-to-side.

Figure 17:
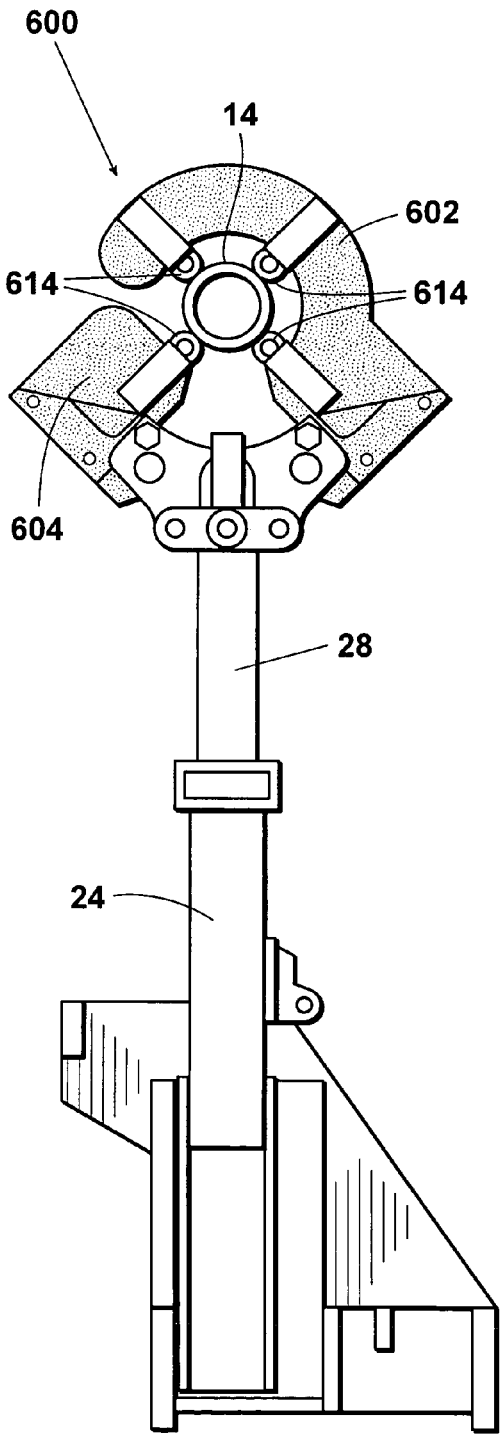
FIG. 17 is a plan view of an embodiment 600 of the inventive stabbing apparatus wherein the grasping members thereof are in a closed position.
Figure 18:
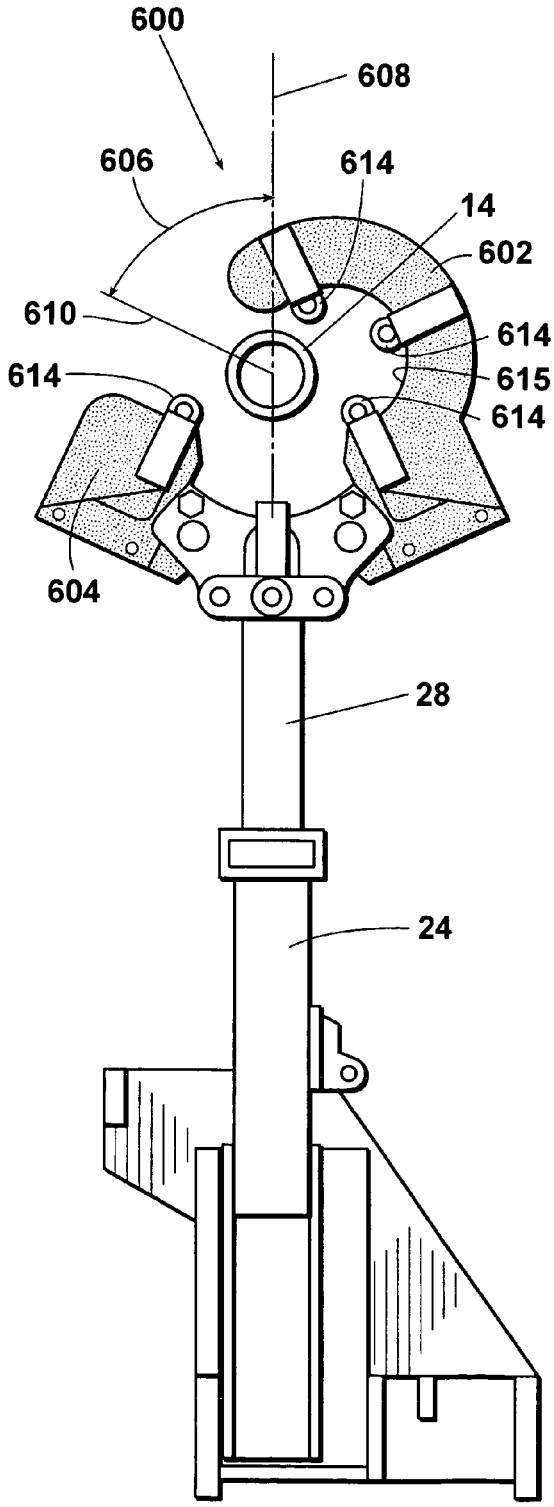
FIG. 18 is a plan view of inventive stabbing apparatus 600 wherein the grasping members thereof are in an open position.

A sixth embodiment 600 of the inventive improved stabbing apparatus is illustrated in FIGS. 17 and 18. The inventive stabbing apparatus 600 utilizes a pair of dissimilar (non-symmetrical) grasping members 602 and 604 which are shaped and pivotably mounted on the distal end of boom 28 in a manner such that, when in open position as illustrated in FIG. 18, the grasping members 602 and 604 are effective for receiving and releasing the suspended tubular 14 at an angle 606 with respect to the longitudinal axis 608 of boom 28. Grasping members 602 and 604 are preferably configured such that, when the grasping members 602 and 604 are in open position, the center point 610 of the gap 612 provided between grasping members 602 and 604 for receiving and releasing the tubular is at an angle 606 of at least 45° from the longitudinal axis 608 of boom 28. This is achieved in the embodiment 600 shown in FIGS. 17 and 18 by using a primary grasping member 602 having a question mark shape wherein the grasping portion thereof has a semi-circular interior 615 which extends over a sufficient arc (preferably at least 180°) to allow three radially adjustable rollers 614 to be positioned therein at 90° intervals. The cooperating grasping member 604 of embodiment 600 includes a single adjustable roller 614 which is preferably located in a manner effective to complete the 90° interval arrangement of the rollers 614 around the circumference of tubular 14, as shown in FIG. 17, when the grasping member 602 and 604 are in closed position.

The inventive apparatus embodiment 600 can include any or all of the other various features and capabilities discussed hereinabove so that: the grasping members 602 and 604 can be pivoted between an unfolded position and a folded position (either up or down); the boom 28 can be extended or retracted; the boom 28 can be pivoted from side-to-side; and/or the entire boom assembly 24 can be pivoted between a substantially horizontal position and either an up or down clearance position.

Figure 19:
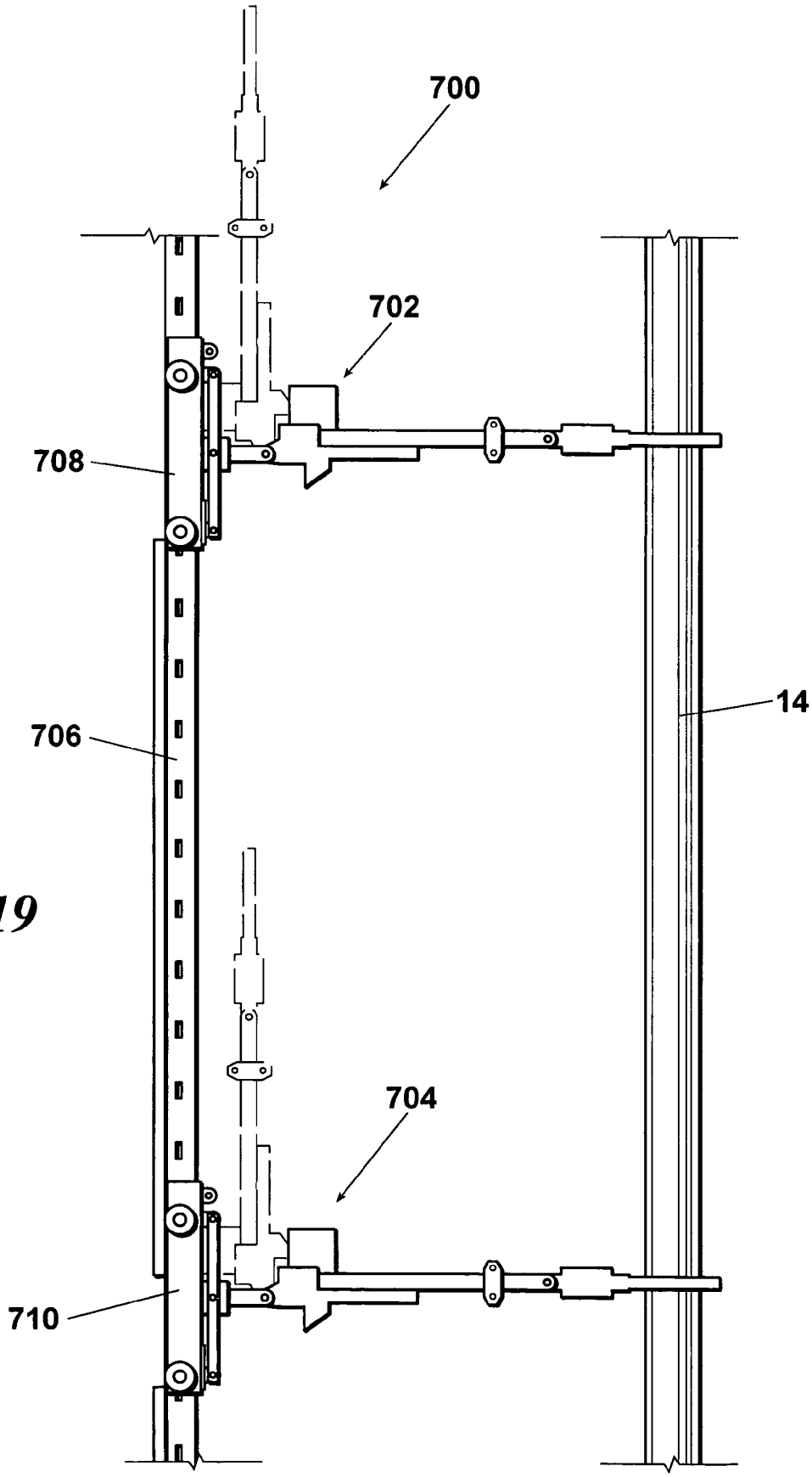
FIG. 19 schematically illustrates an embodiment 700 of an inventive track mounted stabbing apparatus provided by the present invention.

A seventh embodiment 700 of the inventive stabbing apparatus and system is schematically illustrated in FIG. 19. The inventive stabbing system 700 utilizes a plurality (preferably a pair 702 and 704) of stabbing apparatuses which are mounted in the derrick one directly above the other. Although not essentially, the plurality of stabbing apparatuses will also preferably be mounted for up and down movement on a vertical track 706 secured to or within the derrick. The stabbing apparatuses 702 and 704 can be prior art stabbing apparatuses 20 or any of the inventive improved stabbing apparatuses 100, 200, 300, 400, 500, or 600 described hereinabove. The stabbing apparatuses 702 and 704 will preferably be of an identical type and will also preferably be instrumented and/or programmed for synchronized movement in all directions.

The inventive dual stabbing system 700 is particularly effective for stabilizing, handling, and repositioning tubular segments 14 within the derrick structure. Examples of suitable types of vertical tracks 706 useful in improved system 700 include, but are not limited to, parallel track structures, monorail-type tracks, and cog-type track systems. In the embodiment 700 illustrated in FIG. 19, a two rail track structure is employed with stabbing apparatuses 702 and 704 being mounted thereon using vertically movable carts 708 and 710. Generally any type of system known in the art can be used for moving the carts 708 and 710 up and down on track 706. Examples of such drive systems include, but are not limited to, hydraulic motor systems, chain drives, cable winch lifting systems, wire rope lifting apparatuses, etc.

In addition to being highly effective for grasping and stabbing a single tubular 14, the inventive dual stabbing system 700 can also be used for grasping and vertically positioning a pair of tubulars within the derrick for attachment to each other.

The control system provided by the present invention can include generally any desired safety control limit switches or other devices. Such devices may be utilized whenever the motion of the stabbing apparatus must be limited in some way to avoid harming personnel or damaging the stabbing equipment, the rig, or any other equipment being utilized in the rig operations. These devices can be calibrated for the particular environment in which the stabbing apparatus is being utilized.

Figure 20:
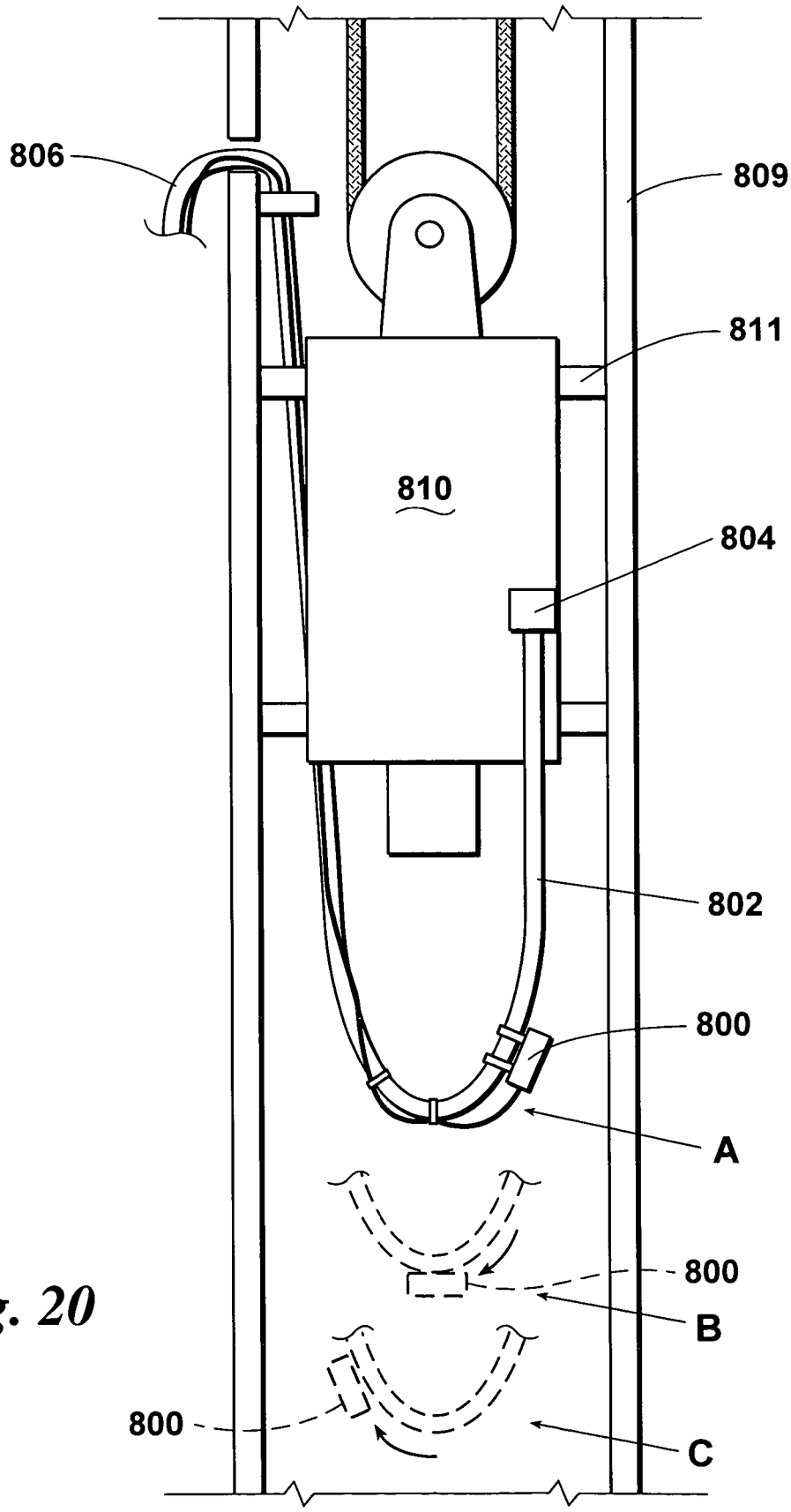
FIG. 20 schematically illustrates an embodiment 800 of an inventive top drive elevation sensing system provided by the present invention.

One example of a safety limit system provided by the present invention is illustrated in FIG. 20. The inventive system utilizes a level sensor 800 to monitor the elevational position of the derrick system crown block or other top drive system 810 to ensure that the stabbing apparatus does not interfere with other rig operations, such as the raising or lowering of the top drive 810 or the traveling block or other equipment suspended therefrom. The sensor 800 can be a conventional level sensor such as, for example, a mercury level switch.

In its substantially horizontal operating position, the stabbing apparatus will typically extend to approximately the centerline of a rig and can thus interfere with and/or be contacted by other rig equipment when not in use. After a tubular is threadedly attached to the upper end of the tubular string, the stabbing apparatus releases the tubular, the boom is retracted, and the stabbing apparatus is pivoted and/or folded away from the tubular. Subsequently, or at the same time that the stabbing apparatus is being retracted, the top drive system lowers the attached tubular into the well bore. The sensor 800 will alert the rig personnel whenever the top drive 810 or the equipment suspended therefrom has moved to a position where possible interference with the stabbing apparatus can occur and will also preferably be used as described hereinbelow to prevent a collision from occurring.

In the embodiment illustrated in FIG. 20, the level sensor 800 is attached to the top drive service loop 802. This method of attachment allows the level sensor 800 to remain attached to the same point on the service loop hose 802 and to be detached therefrom without damaging the hose or the sensor. The attachment can include, but is not limited to, the use of hose clamps, U-bolts, brackets, straps, and other suitable attachment devices. In a conventional arrangement, the service loop hose 802 is anchored at one end 804 to the top drive 810. The other end of the service loop hose 802 is preferably attached at some stationary anchor point 806 on the derrick. As the top drive 810 is lowered or raised, the lower-most point of the suspended service loop 802 will change. Thus, the level sensor 800 position will shift vertically with the vertical movement of the top drive 810.

The level sensor 800 illustrated in FIG. 20 can be triggered and/or actuated when the sensor moves downwardly from a substantially vertical position (designated as position "A" in FIG. 20) to a substantially horizontal position (designated as position "B" in FIG. 20) and/or when it moves further downward from the substantially horizontal position "B" to a second substantially vertical position (designated as position "C" in FIG. 20). Alternatively, if desired, the level sensor 800 can be triggered and actuated as it moves upwardly through levels "C," "B," and "A".

It will be understood that the inventive system is not limited to the use of a mercury level switch. Generally any device can be used which can be positioned in a manner effective for accurately determining an elevational position of the top drive 810, the traveling block, and/or the equipment suspended therefrom. One example of an alternative device is a range finding laser sensor proximity switch magnetic or photo electric or mechanical switch which could be mounted to the derrick, or to the stabbing apparatus, or could be affixed along the top drive guide rails 809 and be triggered by the passing of the top drive rollers 811. In any case, the specific type of sensor used and its location can be a function of the type of rig, the operational plan, the rig environment, and the type of equipment being utilized.

In addition, the sensor 800 is not limited to use only in conjunction with a stabbing operation or a stabbing apparatus. The sensor 800 may be utilized to sense and indicate the position of the top drive system or of the traveling block or other equipment suspended therefrom in conjunction with virtually any application or operation. Thus, the sensor 800 may be utilized to avoid a collision of the traveling block with any equipment being handled or run in conjunction with any drilling, servicing, or production operation.

Figure 21:
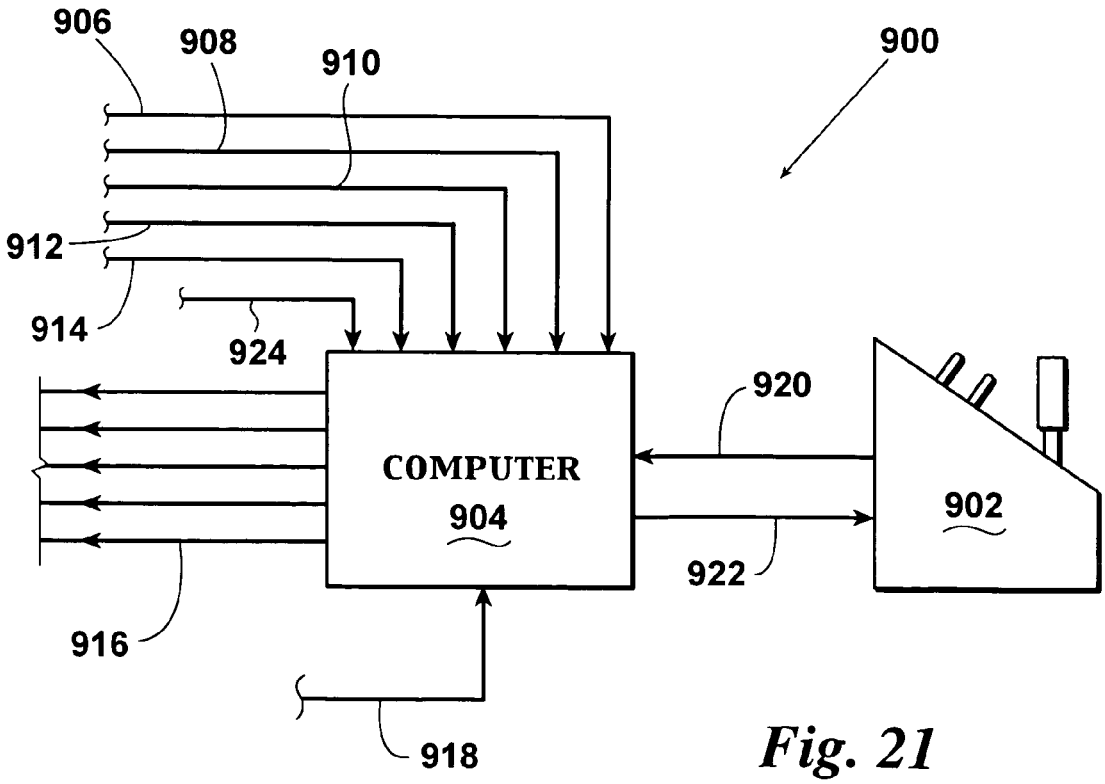
FIG. 21 schematically illustrates an embodiment 900 of a stabbing and control system provided by the present invention.

An embodiment 900 of the operating system provided by the present invention is schematically illustrated in FIG. 21. The operating system 900 can be used in conjunction with any of the stabbing apparatuses described above and comprises: a remote control operating panel 902; a computer processing unit 904; a series of position signal feed lines 906-914 which provide signals and/or data to the processing unit 904 indicating, respectively, the pivoted position of the boom, the extended/retracted position of the boom, the side-to-side pivoted position of the boom, the folded/unfolded position of the grasping member(s), and the grasping/releasing position of the grasping member(s); a bundle of individual control lines 916 extending from the processing unit 904 for operating the individual piston and cylinder assemblies or other devices used in the stabbing apparatus to accomplish all of the desired movements thereof; a signal feed line 918 to the processing unit 904 indicating the elevational position of the top drive system or other rig equipment; a command operating line 920 from the remote control panel 902 to the processing unit 904; an indicator and alarm line 922 from the processing unit 904 to the remote control panel 902 for providing status indications, alarms, warnings and other information to the panel operator; and a signal feed line 924 to the processing unit 904 indicating the position and/or status of the rotary table or spider or interlock system used for holding the suspended tubular string in the well.

The control panel 902 can have any desired switches, joysticks, etc. thereon for selectively performing the desired stabbing system operations and can alternatively be either linked to or replaced by a hand-held remote. In addition, although various electrical feed and control lines are used in the embodiment shown in FIG. 21, it will be understood by those in the art that a wireless system or any other type of communication system known in the art could alternatively be used.

Any number of positional feeds 906-914 and any number of operating lines 916 can be used as needed for monitoring and operating the various movement and positioning capabilities of the stabbing apparatus. Although the inventive control system 900 is shown as having five such input and output lines, it will be understood that the inventive system can be used for monitoring and controlling stabbing devices having more or fewer movement capabilities and/or monitoring needs.

The operating system 900 will also preferably be programmed to store operational parameters and information and can be programmed to perform operational procedures and/or automatically return the stabbing apparatus to a precise alignment position. The successful alignment of the first and/or succeeding tubular sections provides valuable positional information as to the necessary alignment positions of the boom and the jaws which can be automatically stored for use in making subsequent connections.

In another aspect, the processing unit 904 can be readily programmed to require redundant commands or other fail safe procedures for performing critical stabbing, releasing, or other operations. The control system can be programmed and/or configured, for example, to require that certain toggle switches or other controls be activated substantially at the same time when performing critical movements. An example of one such critical movement is the release of a tubular section being gripped by the gripping member(s) 30 of the stabbing apparatus. The inadvertent release of a tubular, or the movement of a tubular in a particular direction such that the tubular comes into unintended contact with rig personnel or other equipment, can result in serious damage to equipment or serious injury to the rig personnel. Thus, in the inventive operational method, critical functions of the stabbing system can require redundant controls (e.g., such as the substantially simultaneous activation of two switches) to prevent the execution of a critical function due to a switch being bumped or otherwise inadvertently activated.

As indicated above, the inventive system 900 can also be programmed and used for coordinating the operation of the stabbing apparatus with the top drive system or with any other equipment being operated in the derrick. By way of example, but not by way of limitation, the inventive system 900 could be configured and programmed for automatically stopping or slowing the top drive when a potential interference with the stabbing apparatus is indicated, producing a visible or audible alarm, or automatically moving, pivoting or folding the stabbing apparatus.

In addition, the inventive operating system 900 can be conveniently configured and programmed as desired to (a) provide appropriate alarms when the operator attempts to perform certain operations out of a preferred sequence and/or (b) prevent such operations from being performed until either the necessary prior operation(s) is/are performed or the operator inputs an appropriate override command. For example, in a preferred embodiment of the stabbing operation control method, the boom assembly of the stabbing apparatus will be prevented from being pivoted from its clearance position to its substantially horizontal position if a first condition has been determined to exist. The first condition might be, for example, a determination that the boom is in its extended position. Alternatively, or in addition, the first condition might exist if it has been determined that the grasping member(s) is/are unfolded and/or it has been determined that the grasping member(s) is/are closed. In the event that the first condition is determined to exist, the operator will receive a signal or alarm and/or will be required, before being allowed to pivot the boom to its substantially horizontal position, to first retract the boom, fold the grasping member(s), and/or open the grasping member(s) as necessary to eliminate the first condition.

The inventive operating method can also include the step of preventing the boom from being moved to its extended position in the event that a second condition has been determined to exist. The second condition could exist, for example, if it is determined that the grasping member(s) is/are unfolded. Alternatively, or in addition, depending upon the preferred operating sequence, the second condition might exist if it is determined that the grasping member(s) is/are closed. Thus, if the second condition exists, the operator would preferably be required to first unfold the grasping member(s), open the grasping member(s), or a combination thereof prior to extending the boom.

In addition, the inventive operating method can include the step of preventing the grasping member(s) from being moved from the folded position to the unfolded position in the event that a third condition has been determined to exist. The third condition could exist, for example, if it is determined that the grasping member(s) is/are closed. Alternatively, or in addition, the third condition could exist if the boom is in its extended position. Thus, in order to unfold the grasping member(s), the operator will preferably first be required to either open the grasping member(s), retract the boom, or a combination thereof.

In like manner, the inventive system can also be programmed in reverse order to help insure that a preferred sequence of operations is performed in releasing the tubular and moving the stabbing apparatus from its substantially horizontal grasping position to its clearance position. By way of example, such steps could include: preventing the grasping member(s) from being folded unless the grasping member(s) is/are open and/or the boom is in retracted position; preventing the boom from being retracted unless the grasping member(s) is/are open and/or the grasping member(s) is/are folded; and/or preventing the boom assembly from being pivoted from its substantially horizontal position to its clearance position unless the grasping member(s) is/are open, the grasping member(s) is/are in folded position, and/or the boom has been retracted.

As another example, the inventive system 900 can be programmed to provide appropriate alarms and/or either prevent the stabbing apparatus from releasing the tubular or automatically causing the stabbing apparatus to release the tubular in accordance with appropriate status signals received from the spider or interlock system.

In conjunction with the inventive operating method and system 900, it will be understood by those in the art that various types of sensors and detectors can be used to determine the pivoted position of the boom assembly, the side-to-side yawing position of the boom, the extended/retracted position of the boom, the folded/unfolded position of the grasping member(s), the grasping/releasing position of the grasping member(s), etc. One example of such device is the limiting switch system 35 employed in prior art stabbing apparatus 20 for detecting and limiting the movement of the boom assembly to its substantially horizontal position. However, as another example, the sensors employed in inventive apparatus 900 for providing positional inputs 906-914 can be proximity switch position detectors of a type known in the art which will determine the positions of the boom and grasping member assembly components and/or retracted/extended positions of each of the various operating piston and cylinder assemblies used in the stabbing apparatus. As will be understood by those in the art, these sensors can readily be calibrated to correspond to and indicate the precise positions of the boom assembly, the boom, and the grasping member(s).

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. In an apparatus for stabbing a suspended tubular, said apparatus including a boom which is pivotable up and down and at least one grasping member carried by said boom, said grasping member being movable relative to said boom in a grasping and releasing movement for grasping and releasing said tubular, the improvement comprising:

said grasping member also being movable relative to said boom in a folding and unfolding movement, different from said grasping and releasing movement, for folding and unfolding said grasping member with respect to said boom;

said grasping member being mounted on said boom by an assembly comprising a first bracket secured on said boom and a second bracket which retains said grasping member for said grasping and releasing movement, wherein said second bracket is pivotably connected to said first bracket for folding and unfolding said grasping member with respect to said boom in accordance with said folding and unfolding movement; and a piston and cylinder assembly connected between said first bracket and said second bracket.

2. The apparatus of claim 1 wherein the improvement further comprises said grasping member being positioned on a distal end of said boom.

3. The apparatus of claim 1 wherein the improvement further comprises said grasping member being mounted on a lateral side of said boom.

4. The apparatus of claim 1 wherein the improvement further comprises said grasping member being carried by a longitudinally extendable and retractable portion of said boom.

5. The apparatus of claim 1 wherein the improvement further comprises said first bracket being removably securable on said boom in a plurality of different positions.

6. The apparatus of claim 1 further including a base for pivotably retaining said boom and wherein the improvement further comprises said boom being downwardly pivotable, with respect to said base, from a substantially horizontal boom position.

7. The apparatus of claim 1 wherein said boom is positionable in a substantially horizontal boom position and wherein the improvement further comprises:

said grasping member being positionable in a substantially horizontal unfolded position when said boom is in said substantially horizontal boom position and said grasping member being pivotable upward from said substantially horizontal unfolded position of said grasping member to a folded position when said boom is in said substantially horizontal boom position.

8. The apparatus of claim 7 wherein the improvement further comprises said grasping member being pivotable at least 60° upward from said substantially horizontal unfolded position of said grasping member when said boom is in said substantially horizontal boom position.

9. The apparatus of claim 1 wherein said boom is positionable in a substantially horizontal boom position and wherein the improvement further comprises:

said grasping member being positionable in a substantially horizontal unfolded position when said boom is in said substantially horizontal boom position and said grasping member being pivotable downward from said substantially horizontal unfolded position of said grasping member to a folded position when said boom is in said substantially horizontal boom position.

10. The apparatus of claim 9 wherein the improvement further comprises said grasping member being pivotable at least 60° downward from said substantially horizontal unfolded position of said grasping member when said boom is in said substantially horizontal boom position.

11. In an apparatus for stabbing a suspended tubular, said apparatus including a boom assembly and a base which retains said boom assembly for pivoting movement of said boom assembly with respect to said base, and said boom assembly comprising a telescoping boom and at least one grasping member carried by a longitudinally extendable and retractable portion of said telescoping boom for releasably grasping said tubular, the improvement comprising said boom assembly being pivotable at least 60° downward, with respect to said base, from a substantially horizontal position.

12. An apparatus for grasping and positioning a tubular suspended in a derrick comprising a first stabbing assembly positioned in said derrick and a second stabbing assembly positioned in said derrick above said first stabbing assembly, said first stabbing assembly and said second stabbing assembly each being mounted for vertical movement in said derrick and said first stabbing assembly and said second stabbing assembly each comprising:

a boom which is either pivotable up and down, pivotable from side-to-side, or both pivotable up and down and pivotable from side-to-side; and at least one grasping member carried by said boom for releasably grasping said tubular, wherein said first stabbing assembly and said second stabbing assembly are each movably mounted on a vertical track positioned in said derrick.

13. An apparatus for grasping and positioning a suspended tubular comprising:

a vertical track;

a first stabbing assembly including a first stabbing assembly boom which is either pivotable up and down, pivotable from side-to-side, or both pivotable up and down and pivotable from side-to-side, and at least one first stabbing assembly grasping member carried by said first stabbing assembly boom for releasably grasping said tubular; and a second stabbing assembly including a second stabbing assembly boom which is either pivotable up and down, pivotable from side-to-side, or both pivotable up and down and pivotable from side-to-side, and at least one second stabbing assembly grasping member carried by said second stabbing assembly boom for releasably grasping said tubular, said first stabbing assembly being moveably mounted on said vertical track and said second stabbing assembly being moveably mounted on said vertical track above said first stabbing assembly.

14. In an apparatus for stabbing a suspended tubular, said apparatus including a boom, a first grasping member, and a second grasping member, said boom having a longitudinal axis, said boom being either pivotable up and down, pivotable from side-to-side, or both pivotable up and down and pivotable from side-to-side, said first and said second grasping members being carried by said boom, and said first and said second grasping members being openable and closable for receiving, grasping, and releasing said tubular, and wherein when said first and said second grasping members are opened, a gap for receiving or releasing said tubular is formed between said first and said second grasping members, said gap having a center point, the improvement comprising said center point of said gap being located at an angle from said longitudinal axis of said boom, said angle being at least 45° from said longitudinal axis.

15. The apparatus of claim 14 wherein said boom has a distal end and the improvement further comprises said first and said second grasping members being mounted at said distal end of said boom.

16. The apparatus of claim 14 wherein the improvement further comprises said first grasping member having an arcuate interior grasping portion which extends over an arc of at least 180°.

17. In an apparatus for performing well operations comprising a derrick, a top drive suspended in said derrick for vertical movement, and a service hose hanging from said top drive, the improvement comprising a sensor attached to said service hose and positioned in a manner effective for sensing an elevation of said top drive.

18. The apparatus of claim 17 wherein the improvement further comprises said sensor being a mercury level switch.

19. The apparatus of claim 17 wherein said sensor is a first sensor and the improvement further comprises:

a stabbing apparatus positioned in said derrick, said stabbing apparatus having a boom assembly which is either pivotable up and down, pivotable from side-to-side, or both pivotable up and down and pivotable from side-to-side and a second sensor for sensing a position of said boom assembly.

20. The apparatus of claim 19 wherein the improvement further comprises means for receiving signals from said first and said second sensors and determining a proximity of said top drive to said boom assembly.

21. In an apparatus for stabbing a suspended tubular, said apparatus including a telescoping boom which is pivotable up and down and two grasping members carried by a longitudinally extendable and retractable portion of said telescoping boom, said grasping members being movable together cooperatively relative to said telescoping boom in a grasping and releasing movement for grasping and releasing said tubular, the improvement comprising said grasping members also being movable together relative to said telescoping boom in a folding and unfolding movement, different from said grasping and releasing movement, for folding and unfolding said grasping members with respect to said telescoping boom.

22. In an apparatus for stabbing a suspended tubular, said apparatus including a telescoping boom which is pivotable up and down, a base for pivotably retaining said telescoping boom, and at least one grasping member carried by a longitudinally extendable and retractable portion of said telescoping boom, said grasping member being movable relative to said telescoping boom in a grasping and releasing movement for grasping and releasing said tubular, the improvement comprising:

said grasping member also being movable relative to said telescoping boom in a folding and unfolding movement, different from said grasping and releasing movement, for folding and unfolding said grasping member with respect to said telescoping boom and said telescoping boom being pivotable at least 60° downward, with respect to said base, from a substantially horizontal boom position.

23. In an apparatus for performing well operations including a derrick and a top drive, a traveling block, or both a top drive and a traveling block suspended in said derrick for vertical movement, the improvement comprising:

a first sensor positioned in a manner effective for sensing an elevation of said top drive or said traveling block;

a stabbing apparatus positioned in said derrick, said stabbing apparatus having a boom assembly which is either pivotable up and down, pivotable from side-to-side, or both pivotable up and down and pivotable from side-to-side; and a second sensor for sensing a position of said boom assembly.

24. The apparatus of claim 23 wherein the improvement further comprises means for receiving signals from said first and said second sensors and determining a proximity of said top drive or said traveling block to said boom assembly.

25. In an apparatus for stabbing a suspended tubular, said apparatus including a boom assembly and a base which retains said boom assembly for pivoting movement of said boom assembly with respect to said base, and said boom assembly comprising a boom and at least one grasping member carried by said boom for releasably grasping said tubular, the improvement comprising said boom assembly being pivotable at least 90° downward, with respect to said base, from a substantially horizontal position.

26. In an apparatus for stabbing a suspended tubular, said apparatus including a boom which is pivotable up and down, a base for pivotably retaining said boom, and at least one grasping member carried by said boom, said grasping member being movable relative to said boom in a grasping and releasing movement for grasping and releasing said tubular, the improvement comprising:

said grasping member also being movable relative to said boom in a folding and unfolding movement, different from said grasping and releasing movement, for folding and unfolding said grasping member with respect to said boom and said boom being pivotable at least 90° downward, with respect to said base, from a substantially horizontal boom position.

* * * * *